US010345846B1

(12) United States Patent
Bartling et al.

(10) Patent No.: US 10,345,846 B1
(45) Date of Patent: Jul. 9, 2019

(54) REFERENCE VOLTAGE CIRCUIT WITH FLIPPED-GATE TRANSISTOR

(71) Applicant: Apple Inc., Cupertino, CA (US)

(72) Inventors: Ryan D. Bartling, Sunnyvale, CA (US); Jafar Savoj, Sunnyvale, CA (US); Daniel J. Fritchman, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/902,308

(22) Filed: Feb. 22, 2018

(51) Int. Cl.
*G05F 3/24* (2006.01)
*G05F 3/26* (2006.01)

(52) U.S. Cl.
CPC ..... *G05F 3/247* (2013.01); *G05F 3/262* (2013.01)

(58) Field of Classification Search
None
See application file for complete search history.

(56) References Cited

U.S. PATENT DOCUMENTS 4,327,320 A 4/1982 Oguey et al.
5,144,223 A * 9/1992 Gillingham ..... G05F 3/30 323/281
5,485,074 A * 1/1996 Tomasini ..... G05F 3/26 323/312
6,313,695 B1 * 11/2001 Ooishi ..... G11C 5/063 326/82
7,808,387 B1 10/2010 Kuhn
9,590,504 B2 * 3/2017 Al-Shyoukh ..... G05F 3/242
9,666,574 B1 * 5/2017 Lee ..... H01L 27/0883
2013/0106394 A1 * 5/2013 Kobayashi ..... G05F 3/242 323/314
2015/0234412 A1 * 8/2015 Al-Shyoukh ..... G05F 3/20 323/313
2015/0234413 A1 * 8/2015 Al-Shyoukh ..... G05F 3/24 323/313
2016/0094124 A1 * 3/2016 Al-Shyoukh ..... G05F 3/242 323/271

* cited by examiner

*Primary Examiner* — Yusef A Ahmed
(74) *Attorney, Agent, or Firm* — Meyertons, Hood, Kivlin, Kowert & Goetzel, P.C.; Erik A. Heter

(57) ABSTRACT

A reference voltage generation circuit (or bandgap circuit) having a flipped-gate transistor is disclosed. A bandgap circuit according to the disclosure includes first, second, third and fourth transistors. The first transistor is a flipped-gate transistor having a gate terminal of an opposite polarity (e.g., an n-channel metal oxide semiconductor, or NMOS, transistor having a gate terminal with a p-type polysilicon implant). The second third and fourth transistors have a corresponding type polysilicon implants (e.g., NMOS transistors having respective gate terminals with an n-type polysilicon implant). The circuit is configured to generate a reference voltage equal to a sum of gate-source voltages of the first and third transistors, minus respective gate-source voltages of the second and fourth transistors.

10 Claims, 6 Drawing Sheets

$Vref = Vgs1 + Vgs3 - Vgs2 - Vgs4$

REFERENCE VOLTAGE CIRCUIT WITH FLIPPED-GATE TRANSISTOR

BACKGROUND

Technical Field

This disclosure is directed to electronic circuits, and more particularly, to circuits used to generate a reference voltage.

Description of the Related Art

Many circuits used in electronic systems and on integrated circuits utilize one or more reference voltages. For example, voltage regulators commonly include an error amplifier having one input on which a reference voltage is received, while a feedback voltage is received on another input. The difference between these two voltages is amplified by the error amplifier, and the output voltage of the voltage regulator is provided based on the reference voltage and the error.

Various types of circuits may be utilized to generate the reference voltage. One commonly used circuit to generate a reference voltage is known as a bandgap circuit. Some bandgap circuits are implemented using bi-polar junction transistors (BJTs), along with other components such as resistors and capacitors. In some smaller integrated circuit processes, metal-oxide semiconductor (MOS) transistors may be used to form circuits for the generation of reference voltages. Other components, such as resistors, may also be implemented on the integrated circuit as part of the bandgap circuit that uses MOS transistors.

SUMMARY

A reference voltage generation circuit (or bandgap circuit) having a flipped-gate transistor is disclosed. In one embodiment, a bandgap circuit includes first, second, third and fourth transistors. The first transistor is a flipped-gate transistor having a gate terminal of an opposite polarity (e.g., an n-channel metal oxide semiconductor, or NMOS, transistor having a gate terminal with a p-type polysilicon implant). The second third and fourth transistors have a corresponding type polysilicon implants (e.g., NMOS transistors having respective gate terminals with an n-type polysilicon implant). The circuit is configured to generate a reference voltage equal to a sum of gate-source voltages of the first and third transistors, minus respective gate-source voltages of the second and fourth transistors.

In one embodiment, the first, second, third and fourth transistors are NMOS transistors. The first transistor, which is the flipped-gate transistor (and which may also be referred to as an anti-doped transistor) has a gate terminal implemented with a p-type polysilicon implant. The remaining NMOS transistors include n-type polysilicon implants on their respective gate terminals. One or more current sources may provide current to one or more of the transistors in the circuit. The reference voltage output from the circuit may be generated based on the currents flowing through the various transistors, with the reference voltage output node being coupled to a source or a drain terminal of a selected one of the transistors. A gate length of at least one of the transistors may be tuned to compensate for temperature-related non-linearities. Compensation may be provided for both first and second order non-linearities.

BRIEF DESCRIPTION OF THE DRAWINGS

The following detailed description makes reference to the accompanying drawings, which are now briefly described.

Figure 1:
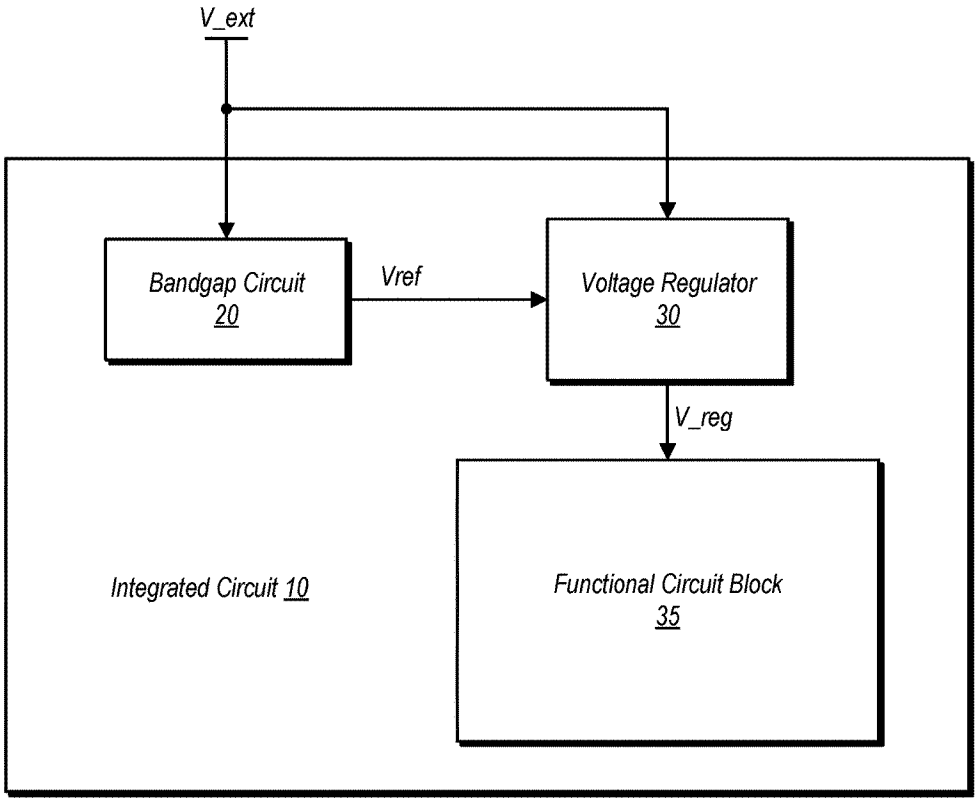
FIG. 1 is a block diagram of one embodiment of an integrated circuit.

Although the embodiments disclosed herein are susceptible to various modifications and alternative forms, specific embodiments are shown by way of example in the drawings and are described herein in detail. It should be understood, however, that drawings and detailed description thereto are not intended to limit the scope of the claims to the particular forms disclosed. On the contrary, this application is intended to cover all modifications, equivalents and alternatives falling within the spirit and scope of the disclosure of the present application as defined by the appended claims.

This disclosure includes references to "one embodiment," "a particular embodiment," "some embodiments," "various embodiments," or "an embodiment." The appearances of the phrases "in one embodiment," "in a particular embodiment," "in some embodiments," "in various embodiments," or "in an embodiment" do not necessarily refer to the same embodiment. Particular features, structures, or characteristics may be combined in any suitable manner consistent with this disclosure.

Within this disclosure, different entities (which may variously be referred to as "units," "circuits," other components, etc.) may be described or claimed as "configured" to perform one or more tasks or operations. This formulation—[entity] configured to [perform one or more tasks]—is used herein to refer to structure (i.e., something physical, such as an electronic circuit). More specifically, this formulation is used to indicate that this structure is arranged to perform the one or more tasks during operation. A structure can be said to be "configured to" perform some task even if the structure is not currently being operated. A "credit distribution circuit configured to distribute credits to a plurality of processor cores" is intended to cover, for example, an integrated circuit that has circuitry that performs this function during operation, even if the integrated circuit in question is not currently being used (e.g., a power supply is not connected to it). Thus, an entity described or recited as "configured to" perform some task refers to something physical, such as a device, circuit, memory storing program instructions executable to implement the task, etc. This phrase is not used herein to refer to something intangible.

The term "configured to" is not intended to mean "configurable to." An unprogrammed FPGA, for example, would not be considered to be "configured to" perform some specific function, although it may be "configurable to" perform that function after programming.

Reciting in the appended claims that a structure is "configured to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke Section 112(f) during prosecution, it will recite claim elements using the "means for" [performing a function] construct.

As used herein, the term "based on" is used to describe one or more factors that affect a determination. This term does not foreclose the possibility that additional factors may affect the determination. That is, a determination may be solely based on specified factors or based on the specified factors as well as other, unspecified factors. Consider the phrase "determine A based on B." This phrase specifies that B is a factor that is used to determine A or that affects the determination of A. This phrase does not foreclose that the determination of A may also be based on some other factor, such as C. This phrase is also intended to cover an embodiment in which A is determined based solely on B. As used herein, the phrase "based on" is synonymous with the phrase "based at least in part on."

As used herein, the phrase "in response to" describes one or more factors that trigger an effect. This phrase does not foreclose the possibility that additional factors may affect or otherwise trigger the effect. That is, an effect may be solely in response to those factors, or may be in response to the specified factors as well as other, unspecified factors. Consider the phrase "perform A in response to B." This phrase specifies that B is a factor that triggers the performance of A. This phrase does not foreclose that performing A may also be in response to some other factor, such as C. This phrase is also intended to cover an embodiment in which A is performed solely in response to B.

As used herein, the terms "first," "second," etc. are used as labels for nouns that they precede, and do not imply any type of ordering (e.g., spatial, temporal, logical, etc.), unless stated otherwise. For example, in a register file having eight registers, the terms "first register" and "second register" can be used to refer to any two of the eight registers, and not, for example, just logical registers 0 and 1.

When used in the claims, the term "or" is used as an inclusive or and not as an exclusive or. For example, the phrase "at least one of x, y, or z" means any one of x, y, and z, as well as any combination thereof.

In the following description, numerous specific details are set forth to provide a thorough understanding of the disclosed embodiments. One having ordinary skill in the art, however, should recognize that aspects of disclosed embodiments might be practiced without these specific details. In some instances, well-known circuits, structures, signals, computer program instruction, and techniques have not been shown in detail to avoid obscuring the disclosed embodiments.

DETAILED DESCRIPTION OF EMBODIMENTS

FIG. 1 is a block diagram of one embodiment of an integrated circuit. It is noted that the embodiment shown here is for illustrative purposes and is not intended to be limiting with regard to the disclosure. For example, while bandgap circuit 20 is shown as providing a reference voltage to voltage regulator 30, embodiments in which a bandgap circuit provides a reference voltage to other types of circuits are possible and contemplated.

In the embodiment shown, integrated circuit (IC) 10 includes functional circuit block 35 configured to carry out various tasks for which the IC was designed. Functional circuit block 35 may include digital circuitry, analog circuitry, and/or mixed-signal circuitry.

Functional circuit block 35 in the embodiment shown is coupled to receive a supply voltage from voltage regulator 30, which can be one of a number of different voltage regulator types. For example, in one embodiment, voltage regulator 30 is a low dropout (LDO) voltage regulator. Generally speaking, voltage regulator 30 may provide a regulated supply voltage to functional circuit block 35.

Although not explicitly shown, voltage regulator 35 includes an error amplifier that is coupled to receive a reference voltage, Vref. Both bandgap circuit 20 and voltage regulator 35 are, in this embodiment, coupled to receive a supply voltage from a source external to IC 10, V_ext.

Bandgap circuit 20 is a voltage reference generation circuit that is configured to generate the reference voltage. In various embodiments disclosed herein, bandgap circuit 20 is implemented using metal oxide semiconductor (MOS) transistors. While various embodiments are implemented using n-channel metal oxide semiconductor (NMOS) transistors, embodiments that utilize p-channel metal oxide semiconductor (PMOS) transistors are possible and contemplated. In general, various embodiments of the bandgap circuit disclosed herein may be implemented in their entirety using CMOS (complementary metal oxide semiconductor) devices. Thus, the various embodiments disclosed herein may exclude the use of discrete components such as resistors and capacitors. Furthermore, each of the embodiments of a bandgap circuit are implemented in such a manner as to compensate for both first and second order non-linearities with respect to temperature variation. As a result, the various embodiments of a bandgap circuit disclosed herein may exhibit a high degree of temperature independence.

Figure 2:
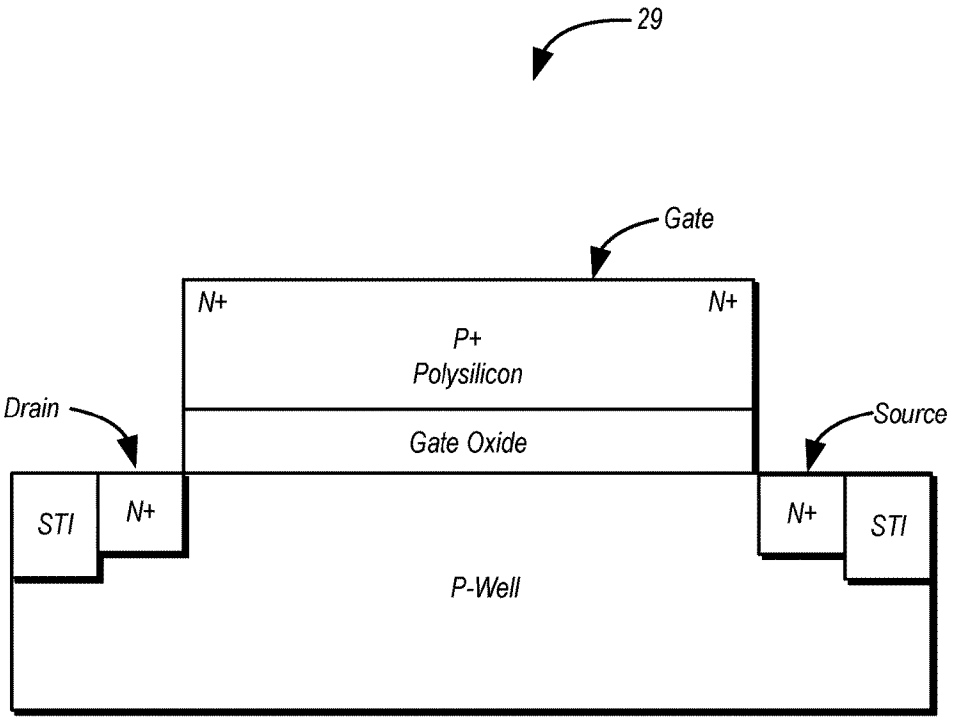
FIG. 2 is a diagram illustrating one embodiment of a flipped-gate transistor.

Various embodiments of a bandgap circuit disclosed herein is implemented using at least one flipped-gate, or anti-doped transistor. FIG. 2 illustrates a side view of one embodiment of a flipped-gate transistor as it would be implemented in silicon. In the embodiment shown, flipped-gate transistor 29 is an NMOS transistor. In a normal (non-flipped-gate) transistor, the gate terminal is implemented using N+ polysilicon. However, in flipped-gate transistor 29, as shown here, the gate terminal is implemented with P+ silicon. As a result, flipped-gate transistor 29 has a high threshold voltage relative to a normal NMOS transistor in which the gate is implemented with a corresponding type of polysilicon in the gate (as defined herein, "corresponding" means, e.g., an NMOS transistor having a gate implemented with N+ polysilicon). While flipped-gate transistor 29 as shown herein has a high threshold voltage, the temperature dependence may similar or effectively the same as other NMOS devices used in the various embodiment of a bandgap circuit disclosed herein.

Each of the embodiments of a bandgap circuit disclosed herein may include one flipped-gate transistor in the circuit portion used to generate the reference voltage (as defined by the sums and differences of the gate-source voltages, as discussed below). The remaining transistors in the circuit portion used to generate the reference voltage may have respective gate terminals with polysilicon implants of corresponding polarity (e.g., NMOS transistors with N+ polysilicon implants).

Figure 3:
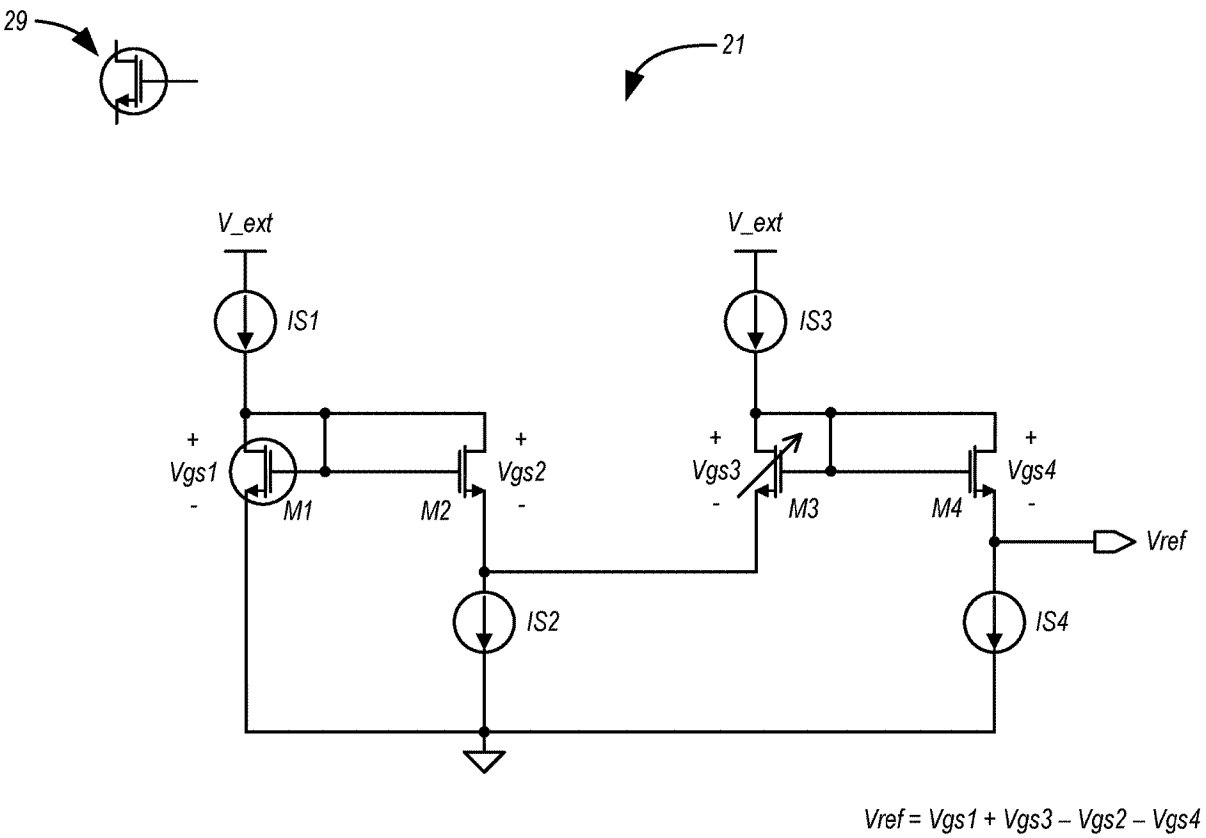
FIG. 3 is a schematic diagram of one embodiment of a reference voltage generation circuit.

Turning now to FIG. 3, a schematic diagram of one embodiment of a bandgap circuit is shown. Bandgap circuit 21 as shown herein may generate a reference voltage, Vref, based on gate-source voltages of four different transistors. In the embodiment shown, four different transistors form the primary circuitry that generates the reference voltage—transistors M1, M2, M3, and M4. Each of these transistors shown here are NMOS transistors, although it is noted that the current sources shown may include PMOS transistors.

Transistor M1 in the embodiment shown is a flipped-gate, or anti-doped transistor 29, as discussed above, with a P+ polysilicon gate. The remaining transistors shown, M2, M3, and M4, are all normal NMOS transistors in which the polysilicon of the gate, N+, corresponds to its respective transistor type, NMOS.

Transistors M1 and M2 in the embodiment shown each include respective drain terminals coupled to a first current source, IS1. Similarly, the respective drain terminals of transistors M3 and M4 are coupled to another current source, IS3. The source terminals of transistors M2 and M3 are each coupled to current source IS2, while the source terminal of transistor M4 is coupled to current source IS4. The source terminal of M1, as well as each of current sources IS2 and IS4 are coupled to a ground/reference node. Current sources IS2 and IS4 draw current through transistor M2 and M4, respectively. In this embodiment, the gate terminals of M1 and M2 are coupled to one another, as well as to their respective source terminals. Accordingly, M1 and M2 are both diode-coupled devices. Similarly, the gate terminals of M3 and M4 are coupled to one another, and are further coupled to their respective source terminals, making these devices diode-coupled as well.

The reference voltage produced by bandgap circuit 21 is based on the various gate-source voltages of transistors M1, M2, M3, and M4. The reference voltage is output from bandgap circuit 21 as the sum of two gate-source voltages (Vgs1 of M1 and Vgs3 of M3) minus the gate source voltages of the other two devices (Vgs2 of M2 and Vgs4 of M4), i.e. Vref=Vgs1+Vgs3−Vgs2−Vgs4.

In the embodiment shown, transistor M3 is the trim device, as indicated by the arrow. For this device, the gate length can be adjusted between different manufacturing runs of an IC upon which bandgap circuit 21 is implemented. Although any of the devices can be designated as trim devices, the circuit shown here may be trimmed using only the single device M3, while the gate lengths of M1, M2, and M4 may be held constant from one manufacturing run to another. It is noted that embodiments are possible and contemplated in which another one of the devices shown is designated as the trim device, as well as embodiments in which more than one of these devices may be designated as trim devices. Nevertheless, bandgap circuit 21 as shown herein excludes trim components such as resistors and capacitors, relying instead solely on transistors. Furthermore, bandgap circuit 21 as shown herein excludes the use of any voltage buffer, and may be suitable for use with low supply voltages.

By utilizing the flipped-gate transistor and trimming the circuit (through the variation of a gate length as discussed above), compensation may be provided for both first and second order non-linearities. Left uncompensated for, non-linearities may cause non-negligible variations in the reference voltage, Vref, with variations in temperature. By compensating for first order non-linearities (or first order temperature coefficients, a term which can be used interchangeably with first order non-linearities in this disclosure), the response of the circuit over a range of temperatures may be graphically shaped similar to a convex parabola, such as a rainbow. For example, in a circuit having compensation for first order coefficients, at a temperature of −40° C. the reference voltage in one embodiment may be 1.257 volts, 1.26 volts at a temperature of 25° C., and 1.257 volts again at 140° C., for a total peak-to-peak variation of 3 millivolts. With compensation for second order coefficients, the variation in this example embodiment may be reduced to under 600 microvolts, which is more than a several integer factor reduction (graphically, the response over the range of temperatures may appear to "snake" around the desired reference voltage, similar to a third-order polynomial around the origin).

As noted above and shown in the drawing, bandgap circuit 21 includes current sources IS1, IS2, IS3, and IS4. These current sources may be implemented using any suitable combination of PMOS and NMOS transistors.

Figure 4:
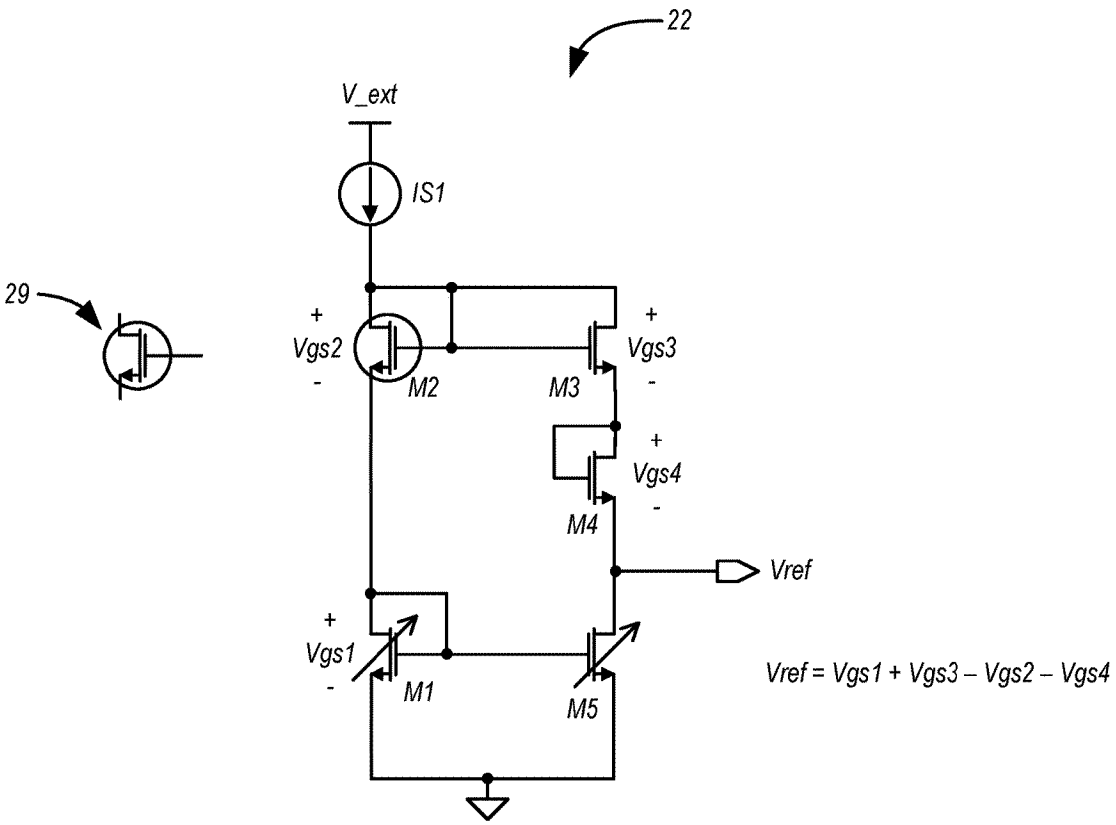
FIG. 4 is a schematic diagram of another embodiment of a reference voltage generation circuit.

FIG. 4 is another embodiment of a bandgap circuit that utilizes a flipped-gate transistor. In the embodiment shown, transistor M2 of bandgap circuit 22 is a flipped-gate NMOS transistor, while transistors M1, M3, M4, and M5 are each NMOS transistors having gate terminals with N+polysilicon implants. A current source, IS1, is coupled to provide a current to the drain gate terminals of M2 and M3. A current mirror is implemented with transistors M1 and M5, with the current through M1 being mirrored through M5. Transistor M4 is a diode-connected device that is coupled in series between M3 and M5. As with the embodiment discussed above, the reference voltage is based on the sum of two gate-source voltages, minus the gate-source voltages of two other gate-source voltages, or Vref=Vgs1+Vgs3−Vgs2−Vgs4. The reference voltage is output from this embodiment at the junction between the source of transistor M4 and drain of M5.

In this particular embodiment, both M1 and M5 are designated as trim devices. Embodiments in which M1, M2, M3, M4, or M5 or a combination thereof are designated as trim devices are also possible and contemplated. The gate lengths of these two transistors may vary from one manufacturing run to the next in order to tune the circuit as part of an effort to compensate second order coefficients. As with the embodiment discussed above, the use of the trim devices and the flipped-gate device may provide compensate for second order coefficients to enable the circuit to provide a steady reference voltage over a wide range of temperatures.

This embodiment, similar to the one discussed for FIG. 3, is implemented in its entirety using transistors. Thus, the circuit excludes the use of discrete components such as resistors and capacitors. Current source IS1 as shown here may be implemented using PMOS and/or NMOS transistors.

Figure 5:
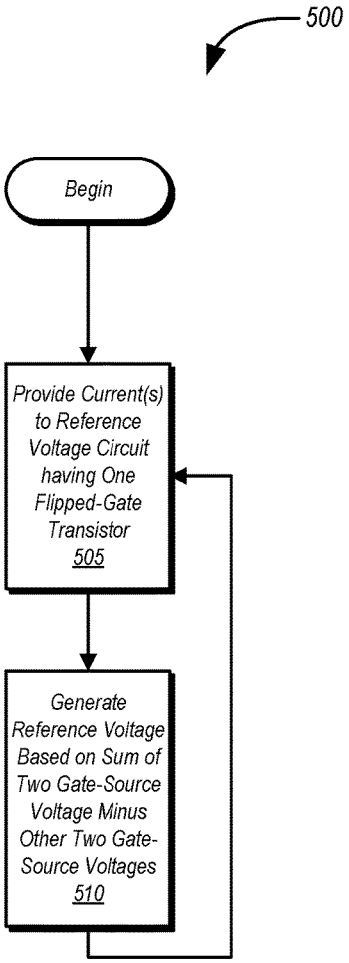
FIG. 5 is a flow diagram of one embodiment of a method for generating a reference voltage.

FIG. 5 is a flow diagram of one embodiment of a method for operating a bandgap, or reference voltage circuit. Method 500 may be implemented by various embodiments of the circuits discussed above, as well as with circuits not explicitly discussed herein.

Method 500 includes the providing of currents to reference voltage circuit that is implemented using one flipped-gate transistor (block 505). The reference voltage circuit used in this method may include additional transistors that are implanted with gate terminals having polysilicon implants corresponding to their respective types (e.g., N+polysilicon for an NMOS transistor). Furthermore, the reference voltage circuit may be implemented to exclude the use of resistors, capacitors, and voltage buffers.

Method 500 further includes the reference voltage circuit generating a reference voltage based on the sum of two transistor's gate-source voltages minus the gate-source voltages of two other transistors (block 510). The circuit may be designed such that it compensates for both first and second order coefficients, and may thus maintain a highly stable reference voltage over a wide range of temperatures.

Figure 6:
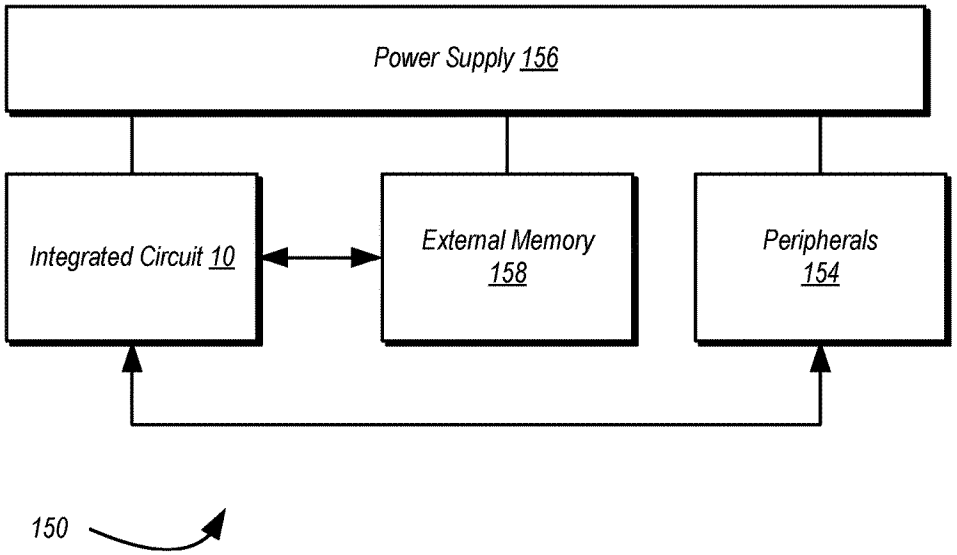
FIG. 6 is a block diagram of one embodiment of an exemplary system.

Turning next to FIG. 6, a block diagram of one embodiment of a system 150 is shown. In the illustrated embodiment, the system 150 includes at least one instance of an integrated circuit 10 coupled to external memory 158. The integrated circuit 10 may include a memory controller that is coupled to the external memory 158. The integrated circuit 10 is coupled to one or more peripherals 154 and the external memory 158. A power supply 156 is also provided which supplies the supply voltages to the integrated circuit 10 as well as one or more supply voltages to the memory 158 and/or the peripherals 154. In some embodiments, more than one instance of the integrated circuit 10 may be included (and more than one external memory 158 may be included as well).

The peripherals 154 may include any desired circuitry, depending on the type of system 150. For example, in one embodiment, the system 150 may be a mobile device (e.g. personal digital assistant (PDA), smart phone, etc.) and the peripherals 154 may include devices for various types of wireless communication, such as WiFi, Bluetooth, cellular, global positioning system, etc. The peripherals 154 may also include additional storage, including RAM storage, solid-state storage, or disk storage. The peripherals 154 may include user interface devices such as a display screen, including touch display screens or multitouch display screens, keyboard or other input devices, microphones, speakers, etc. In other embodiments, the system 150 may be any type of computing system (e.g. desktop personal computer, laptop, workstation, tablet, etc.).

The external memory 158 may include any type of memory. For example, the external memory 158 may be SRAM, dynamic RAM (DRAM) such as synchronous DRAM (SDRAM), double data rate (DDR, DDR2, DDR3, LPDDR1, LPDDR2, etc.) SDRAM, RAMBUS DRAM, etc. The external memory 158 may include one or more memory modules to which the memory devices are mounted, such as single inline memory modules (SIMMs), dual inline memory modules (DIMMs), etc.

Numerous variations and modifications will become apparent to those skilled in the art once the above disclosure is fully appreciated. It is intended that the following claims be interpreted to embrace all such variations and modifications.

What is claimed is:

1. A circuit comprising:

first, second, third, and fourth n-channel metal oxide semiconductor (NMOS) transistors, wherein one of the first, second, third and fourth NMOS transistors is a flipped-gate transistor having a gate terminal including a p-type polysilicon implant, and wherein remaining ones of the first, second, third and fourth NMOS transistors have respective gate terminals with n-type polysilicon implants, wherein respective gate terminals of the second and third NMOS transistors are coupled to one another, wherein the second NMOS transistor is the flipped-gate transistor, and wherein a drain terminal of the second NMOS transistor is coupled to a current source; and a fifth NMOS transistor, wherein respective gate terminals of the first and fifth NMOS transistors are coupled to one another, wherein the first and fifth NMOS transistors form a current mirror, and wherein the fifth NMOS transistor includes a respective gate terminal with an n-type polysilicon implant;

wherein the circuit is configured to generate a reference voltage equal to a sum of respective gate-source voltages of two of the first, second, third, and fourth NMOS transistors minus respective gate-source voltages of a remaining two of the first, second, third, and fourth NMOS transistors.

2. The circuit as recited in claim 1, wherein at least one of the first, second, third, and fourth NMOS transistors is tuned to have a respective gate length to provide compensation for first and second order temperature related nonlinearities.

3. The circuit as recited in claim 1, wherein the fourth NMOS transistor is coupled in series between the third NMOS transistor and the fifth NMOS transistor, wherein the reference voltage is output from a node coupled to a source terminal of the fourth NMOS transistor.

4. The circuit as recited in claim 1, wherein the current source is further coupled to a drain terminal of the third NMOS transistor.

5. The circuit as recited in claim 1, wherein the first NMOS transistor is diode-coupled.

6. A method comprising:

providing at least one current to a reference voltage circuit, the reference voltage circuit including:

first, second, third, and fourth n-channel metal oxide semiconductor (NMOS) transistors, wherein one of the first, second, third and fourth NMOS transistors is a flipped-gate transistor having a gate terminal including a p-type polysilicon implant, and wherein remaining ones of the first, second, third and fourth NMOS transistors have respective gate terminals with n-type polysilicon implants; and generating a reference voltage based on a sum of gate-source voltages of the first and third NMOS transistors minus gate-source voltages of the second and fourth NMOS transistors;

wherein the first NMOS transistor is the flipped-gate transistor, and wherein the method further comprises:

providing a first current to a drain terminal of the first NMOS transistor;

providing a second current to a drain terminal of the third NMOS transistor;

drawing a third current from a source terminal of the second NMOS transistor;

drawing a fourth current from a source terminal of the fourth NMOS transistor; and providing the reference voltage as an output from the reference voltage circuit from the source terminal of the fourth NMOS transistor.

7. An integrated circuit comprising:

a voltage regulator circuit configured to supply a regulated supply voltage to a functional circuit block, wherein the regulated supply voltage is based on a reference voltage; and a reference voltage circuit coupled to supply the reference voltage to the voltage regulator circuit, wherein the reference voltage circuit includes:

first, second, third and fourth transistors, wherein one of the first, second, third and fourth transistors is an anti-doped transistor having a gate terminal having a polysilicon implant of an opposite polarity and wherein remaining ones of the first, second, third and fourth transistors include respective gate terminals with polysilicon implants of a corresponding polarity;

a first current source coupled to a drain terminal of the first transistor, wherein the first transistor is the anti-doped transistor;

a second current source coupled to a drain terminal of the third transistor;

a third current source coupled to respective source terminals of the second and third transistors; and a fourth current source coupled to a source terminal of the fourth transistor;

wherein respective gate terminals of the third and fourth transistors are coupled to one another wherein the reference voltage circuit is configured to generate the reference voltage at a value equal to a sum of respective gate-source voltages of the first and third transistors minus respective gate-source voltages of the second and fourth transistors.

8. The integrated circuit as recited in claim 7, wherein the first, second, third and fourth transistors are n-channel metal oxide semiconductor (NMOS) transistors.

9. The integrated circuit as recited in claim 7 wherein one or more of the first, second, third, and fourth transistors are tuned to have respective gate lengths to provide compensation for first and second order temperature related non-linearities.

10. The integrated circuit as recited in claim 7, wherein the reference voltage is output from a node coupled to the source terminal of the fourth transistor.

* * * * *